US007682286B2

(12) United States Patent
Badarneh et al.

(10) Patent No.: US 7,682,286 B2
(45) Date of Patent: Mar. 23, 2010

(54) TRAINING APPARATUS

(75) Inventors: Ziad Badarneh, Carl Kjelsensvei 34, Oslo (NO) N-0874; Campbell Ellis, Oslo (NO); Benedict J. M. Hansen, Oslo (NO); Torbjørn Mollatt, Oppegård (NO)

(73) Assignee: Ziad Badarneh, Oslo (NO)

( * ) Notice: Subject to any disclaimer, the term of this patent is extended or adjusted under 35 U.S.C. 154(b) by 775 days.

(21) Appl. No.: 10/579,322

(22) PCT Filed: Nov. 15, 2004

(86) PCT No.: PCT/NO2004/000349

§ 371 (c)(1),
(2), (4) Date: Jul. 31, 2006

(87) PCT Pub. No.: WO2005/046806

PCT Pub. Date: May 26, 2005

(65) Prior Publication Data

US 2007/0072744 A1 Mar. 29, 2007

(30) Foreign Application Priority Data

Nov. 17, 2003 (NO) ..... 20035129
Aug. 24, 2004 (NO) ..... 20043530

(51) Int. Cl.
*A63B 71/00* (2006.01)

(52) U.S. Cl. ..... 482/5; 482/4; 482/57; 482/64

(58) Field of Classification Search ..... 482/1–9, 482/51, 57, 61, 63–65, 900–902; 434/247
See application file for complete search history.

(56) References Cited

U.S. PATENT DOCUMENTS

| | | | | | |
|---|---|---|---|---|---|
| 2,788,211 | A | * | 4/1957 | Ivanoff | 482/4 |
| 5,064,213 | A | * | 11/1991 | Storch | 280/301 |
| 5,240,417 | A | * | 8/1993 | Smithson et al. | 434/61 |
| 5,312,311 | A | * | 5/1994 | Pearson | 482/57 |
| 5,890,995 | A | | 4/1999 | Bobick et al. | |
| 5,967,946 | A | * | 10/1999 | Beatty, Jr. | 482/61 |
| 6,126,577 | A | * | 10/2000 | Chang | 482/57 |

FOREIGN PATENT DOCUMENTS

| | | | |
|---|---|---|---|
| EP | 0354785 | A | 2/1990 |
| GB | 2341331 | A | 3/2000 |
| WO | WO 0068067 | A | 11/2000 |
| WO | WO 03018391 | A | 3/2003 |

* cited by examiner

*Primary Examiner*—Glenn Richman
(74) *Attorney, Agent, or Firm*—Rodman & Rodman

(57) ABSTRACT

Training apparatus for physical exercise, preventive exercise and rehabilitation of injuries and increased balance, the apparatus designed as a stationary exercise bicycle, similar to ergometer bikes or spinning bikes. The apparatus consist of a first lower stable frame configured to be supported on a floor and a second upper frame tiltable relative to the lower frame. The upper frame has an adjustable tilt movement relative the lower frame crosswise the flywheel's revolving motion. A steering gear is guided through the upper frame where a prolonged part of the steering gear is in contact with the floor, the part having a wheel suspension like design, consisting of barlinks, dampers, springs and wheels. Stabilizing of the upper frame is done by movement of the steering gear.

11 Claims, 10 Drawing Sheets

TRAINING APPARATUS

This invention relates to a training apparatus for exercise and rehabilitation of a person's muscles and is especially adapted to designs, which are related to principles of training during instability and controlling balance when performing a training exercise.

This invention represents a new design for an indoor exercise bicycle. The exercise bicycle is unstable tiltable with a system for controlling the instability, simulating a feeling of riding an ordinary mobile bicycle.

There is especially a lot of ankle and knee-injuries in a majority of athletics and sports. The injuries are often complicated, difficult and take long time to rehabilitate. During rehabilitation of leg injuries walking and running is limited and exercise is often supplied using training apparatus such as bicycles.

However, not everybody can or has the opportunity to go for a bicycle ride on road or off road. On the market exists a number of training apparatus for indoor use, as ergometer cycles or spinning cycles. However these apparatus do not provide any system for instability and do not give any good simulation of riding on road or track as when bicycling. Use of such ergometer cycles or spinning cycles gives a person monotonous movement and gives little exercise of muscles which strengthen joints and which contribute to increased balance.

One of the inventors earlier PCT application with publication number WO00/68067, describes a pedal with tilt function, the pedal rotatable attached to a crank arm on apparatus for physical exercise, for example a bicycle or other exercise apparatus utilising a rotatable crank. In long terms, use of such a pedal solution will provide for unique advantages to the user regarding rehabilitation and prevention of injuries and together further dynamic skills to the user.

As such the inventor wants to show how a complete training apparatus in form of an exercise bicycle is designed with functions of instability to stimulate a users strength and balance in legs, hips, and back.

The invention is an indoor stationary exercise bicycle, which includes a first lower frame stable relative to a floor, which supports a second upper frame. The upper frame has a seat, crank and pedals connected to a flywheel with means of resistance. The upper frame has an adjustable tilt movement relative to the lower frame crosswise the overall length of the apparatus and the flywheel's revolving motion. A steering gear is guided through the upper frame where a prolonged part of the steering gear is in contact with the floor, the part having a wheel suspension like design, consisting of wheels or rollers and dampers or shock absorbers and or springs. Stabilizing of the upper frame is done by movement of the steering gear.

The features of the invention will be described with reference to accompanying drawings, which illustrates preferred embodiments of the invention by example and in which.

Figure 4A:
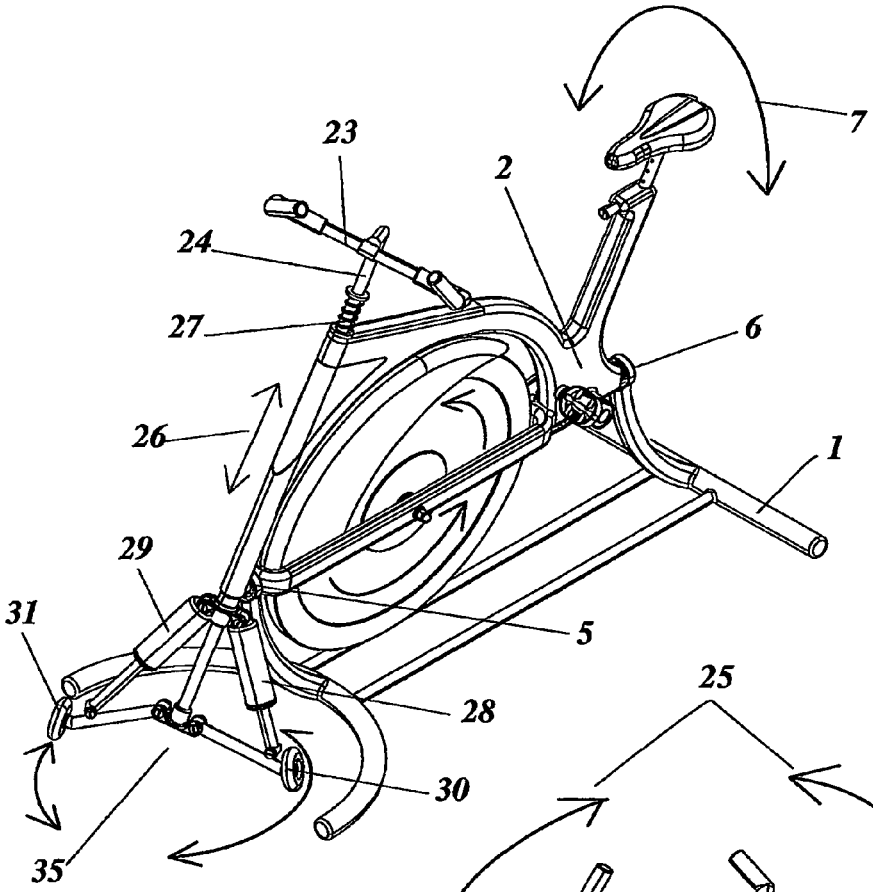
Figure 4B:
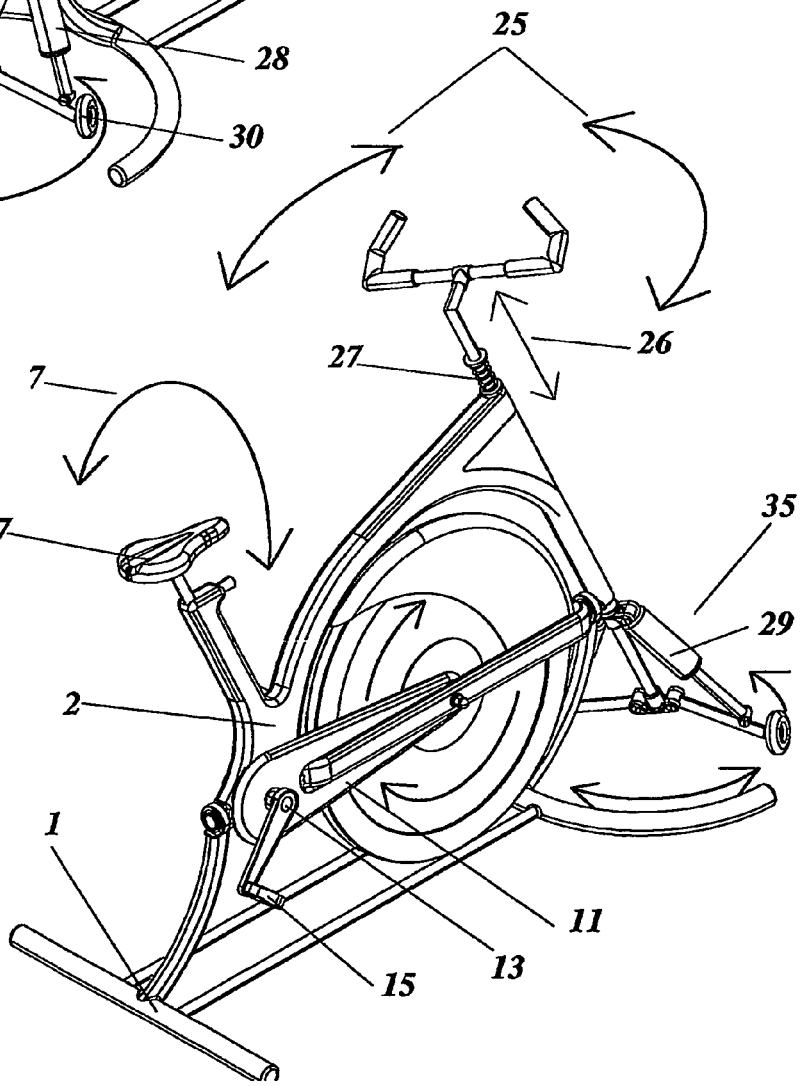
Figure 5:
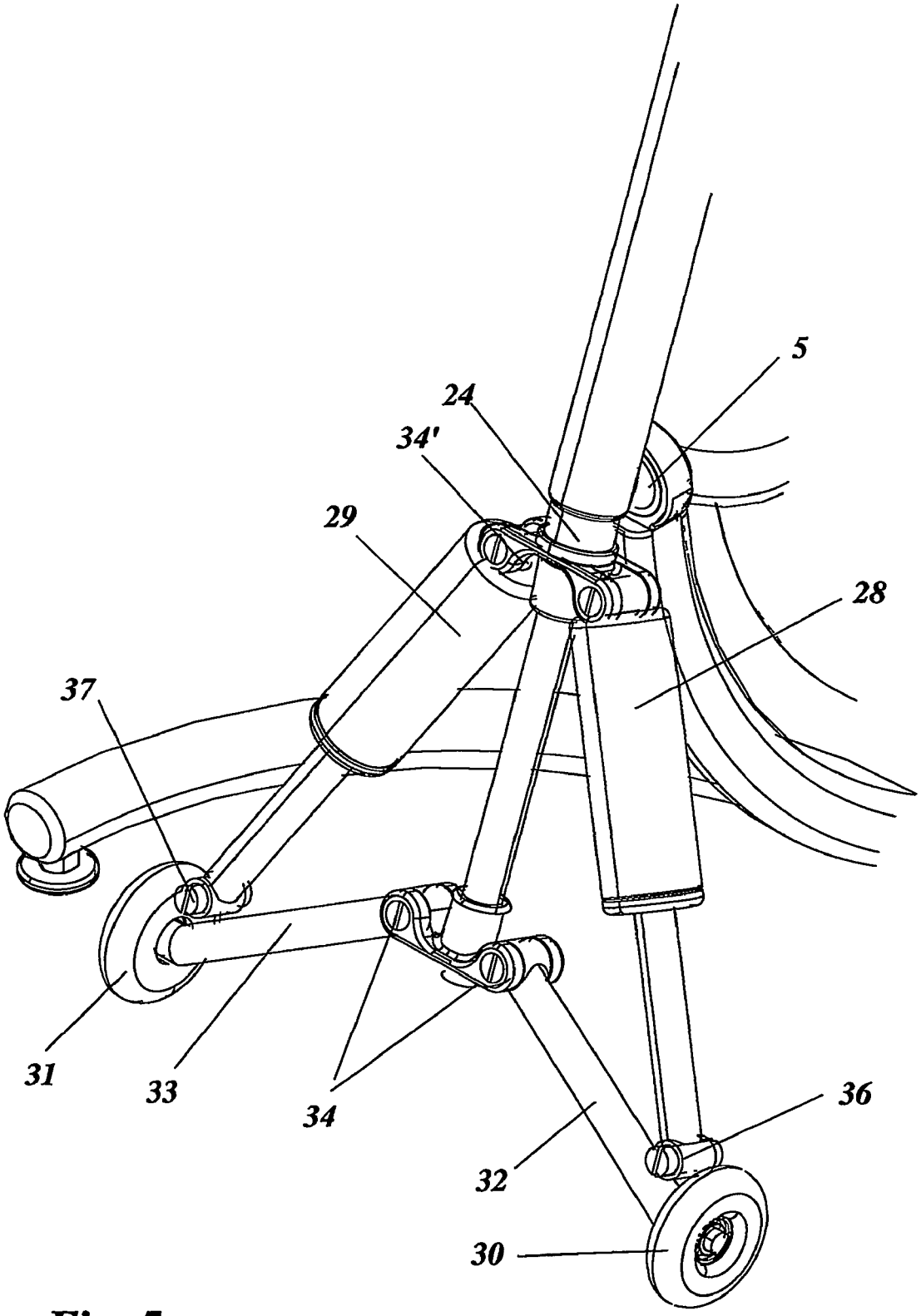
Figure 6:
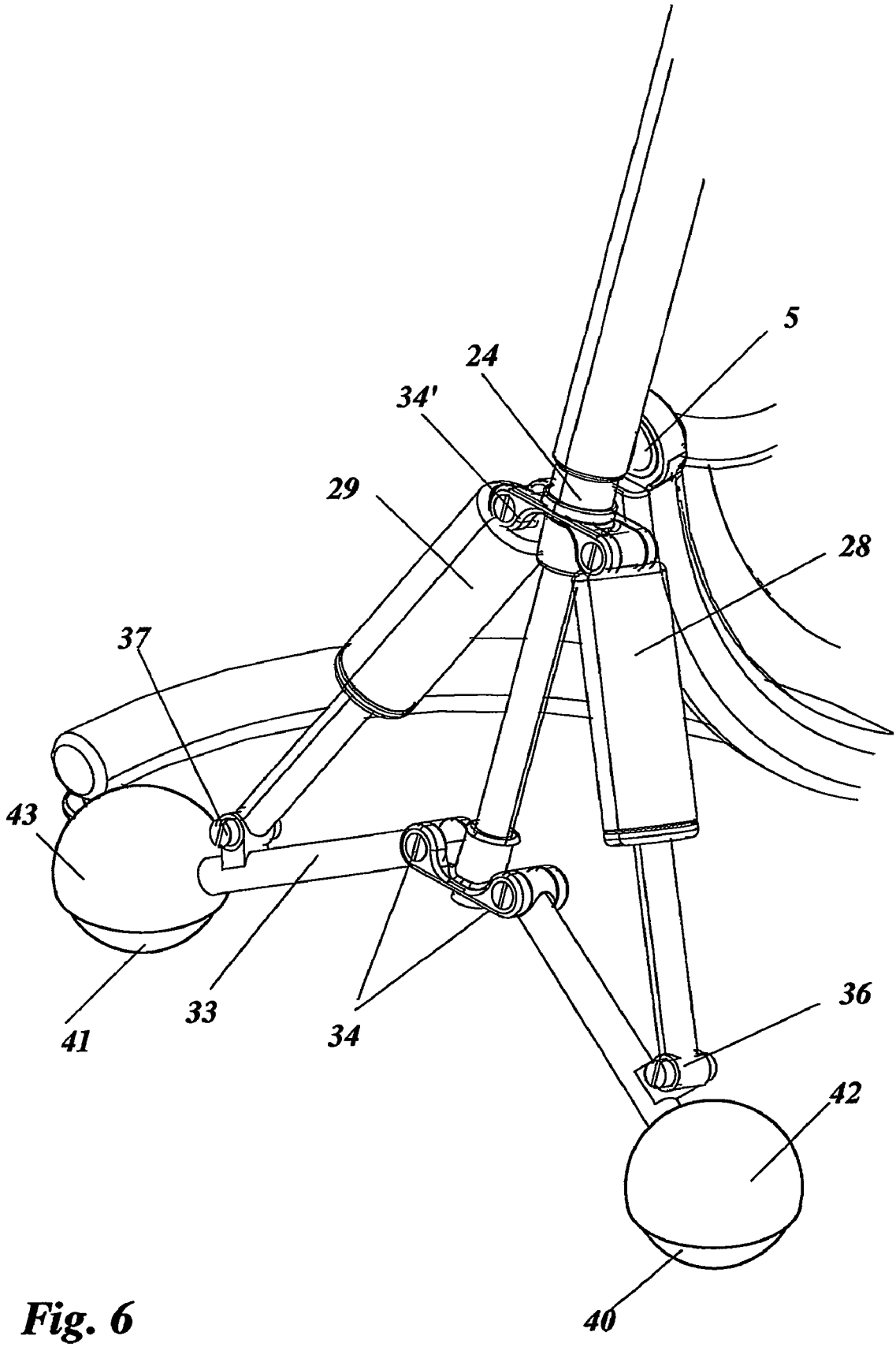
Figure 7:
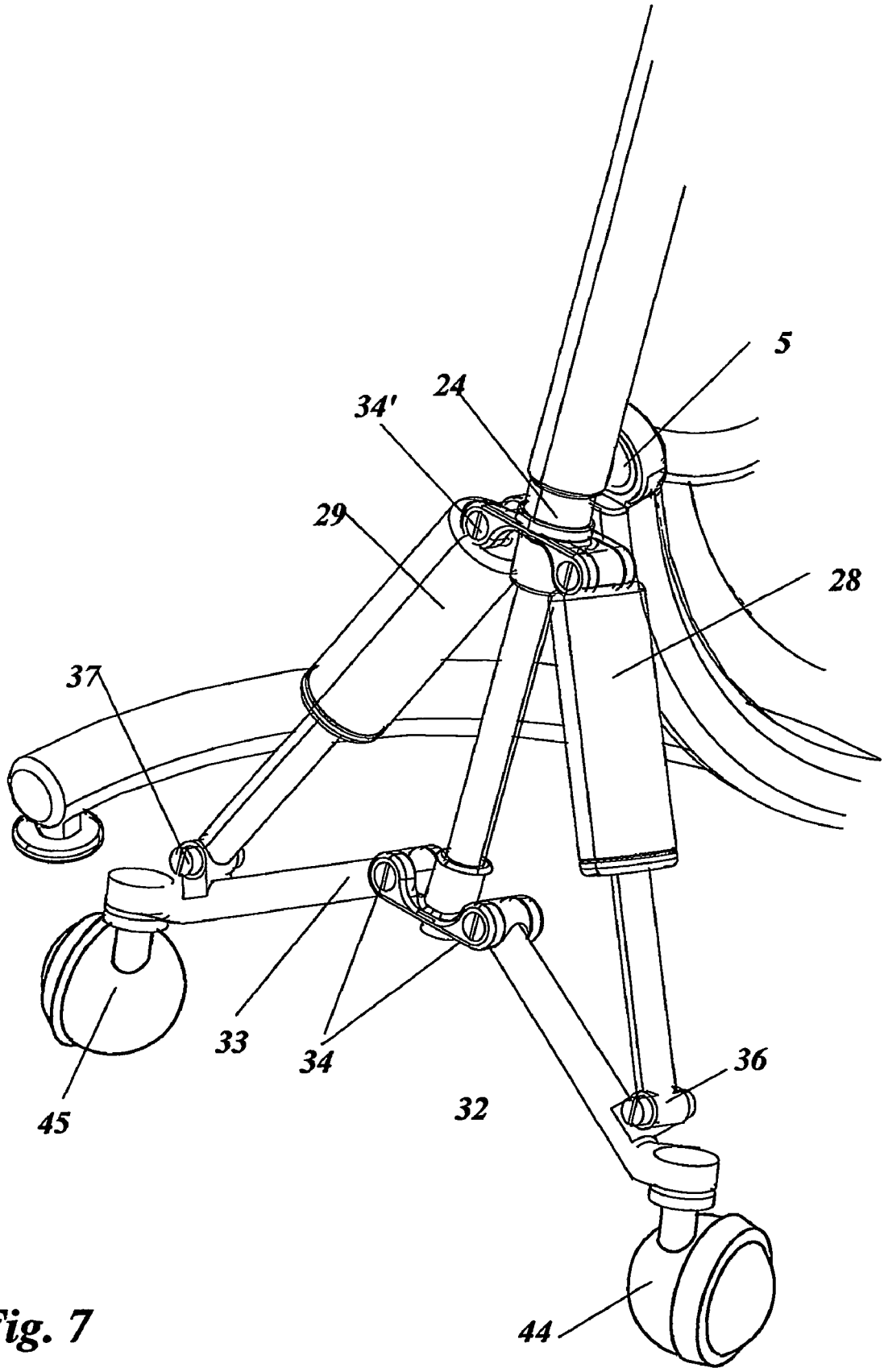
Figure 8:
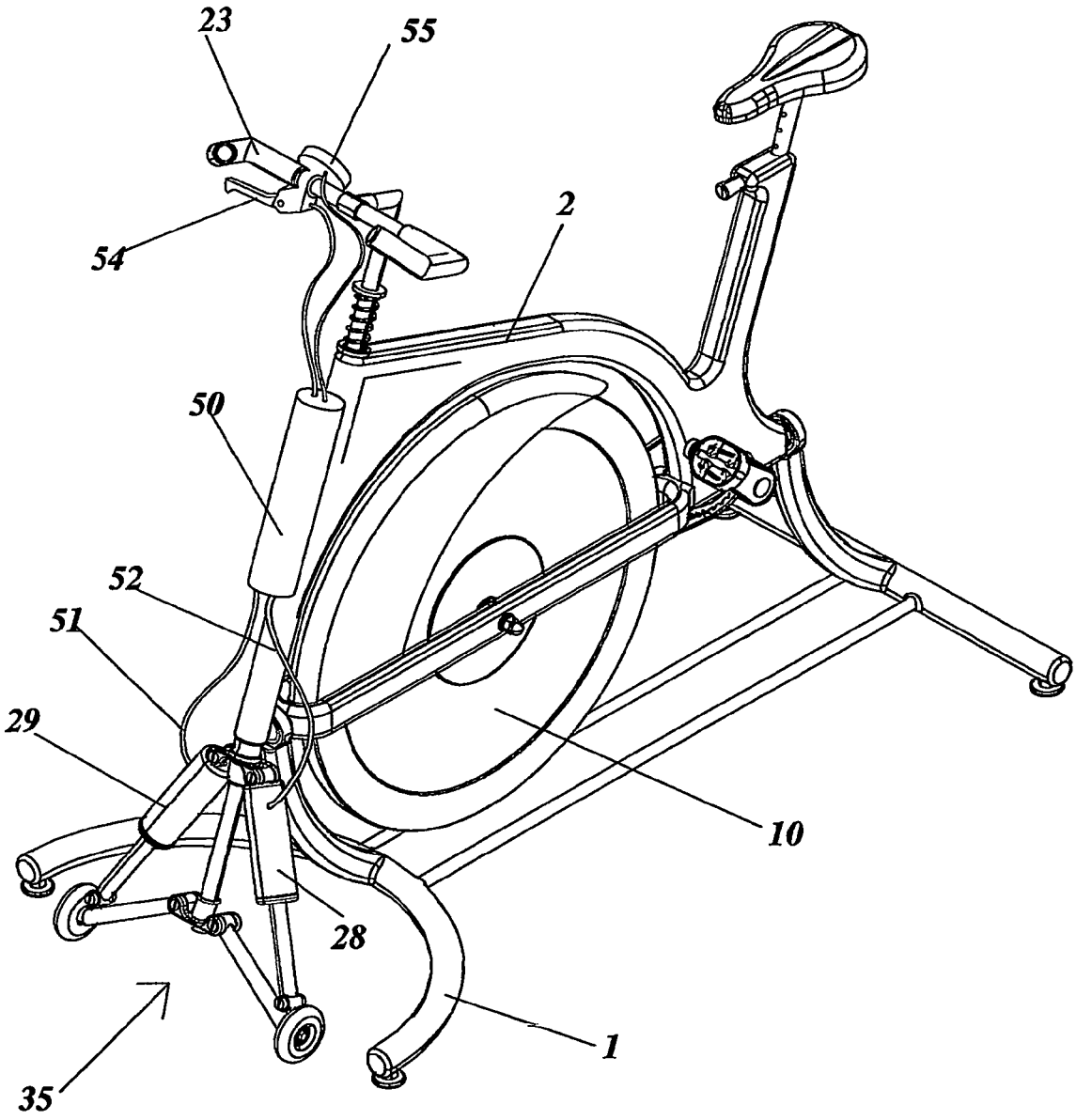

FIG. 4*a*-4*b* show the functionality of the invention;

FIG. 5 shows a detail of a first embodiment of a "wheel suspension";

FIG. 6 shows a detail of a second embodiment of a "wheel suspension";

FIG. 7 shows a detail of a third embodiment of a "wheel suspension";

FIG. 8 shows the invention with a mechanism for adjusting the tilt function.

Figure 9:
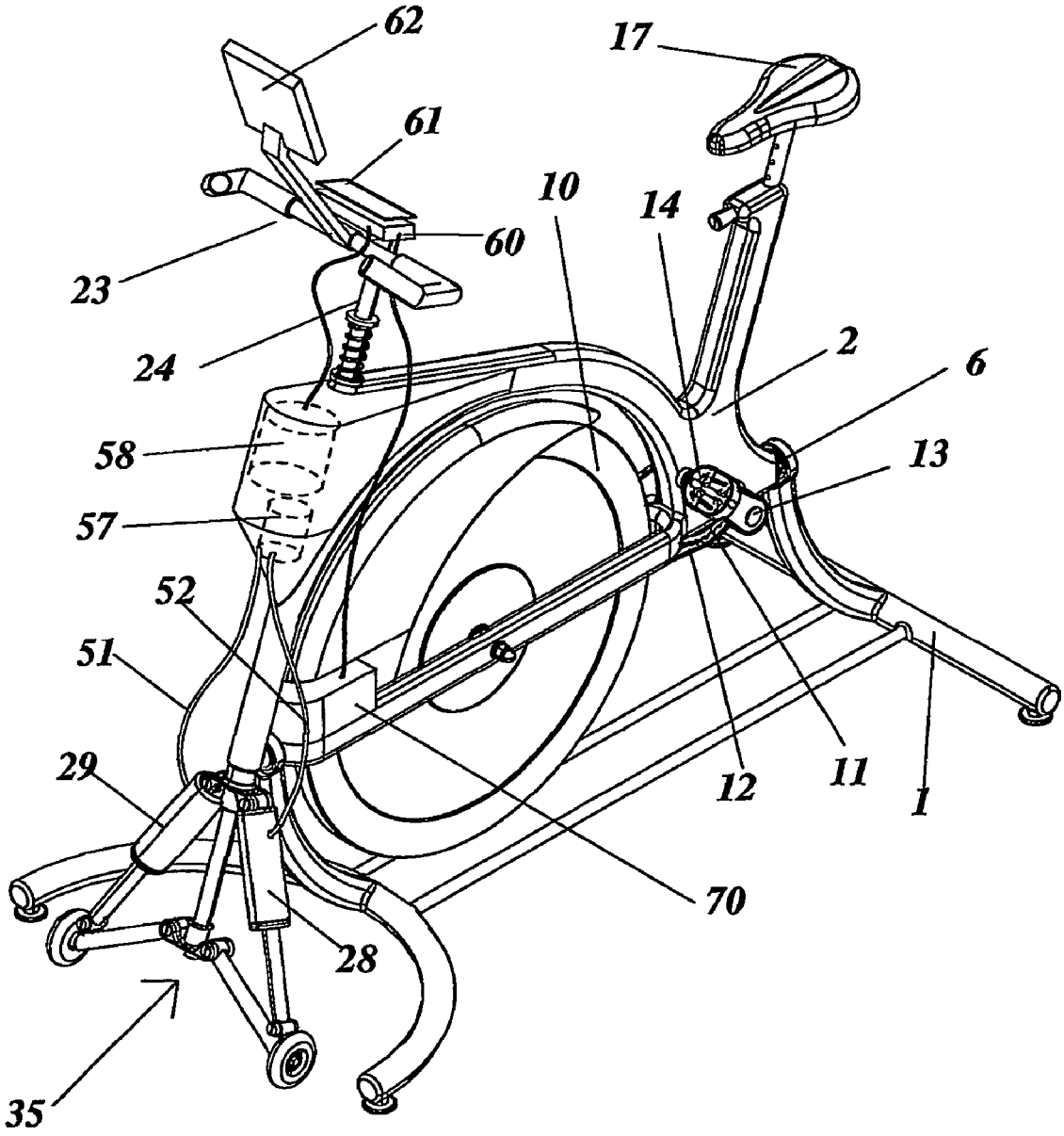

FIG. 9 shows the invention with means for operating its functions.

Figure 10:
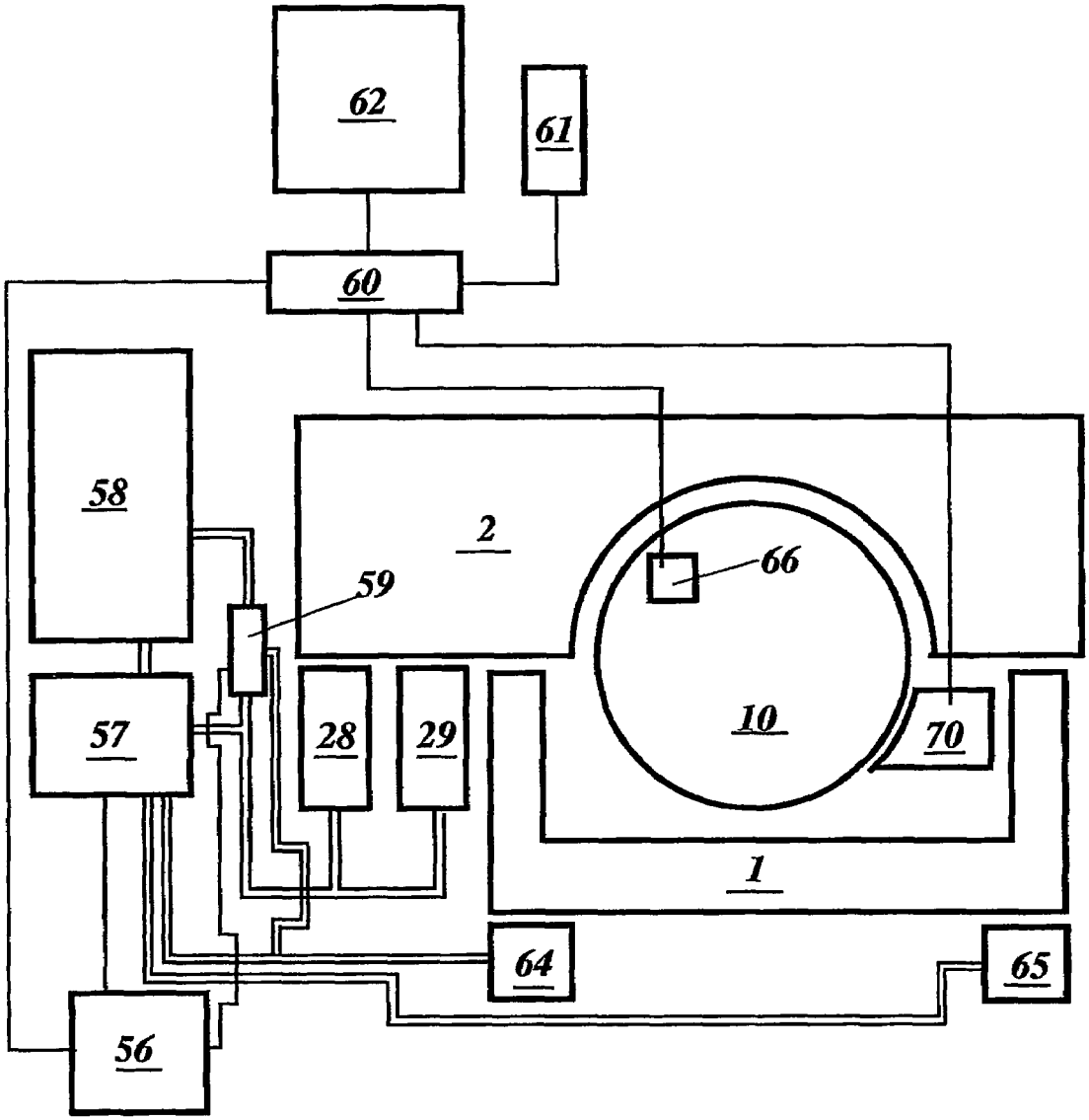

FIG. 10 shows a block schematic which illustrates the relation between the different components within the invention.

Figure 11A:
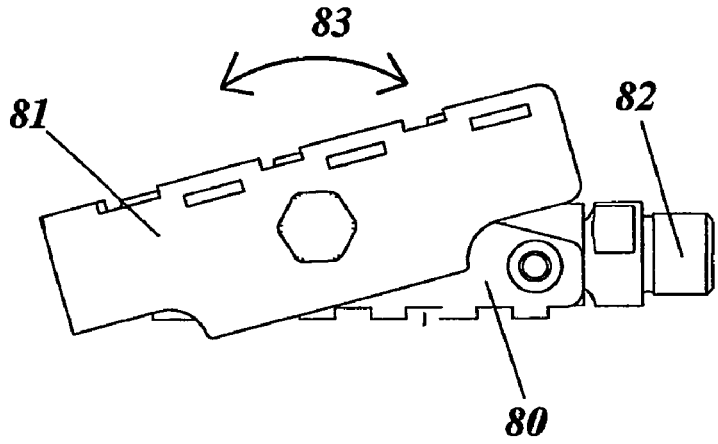
Figure 11B:
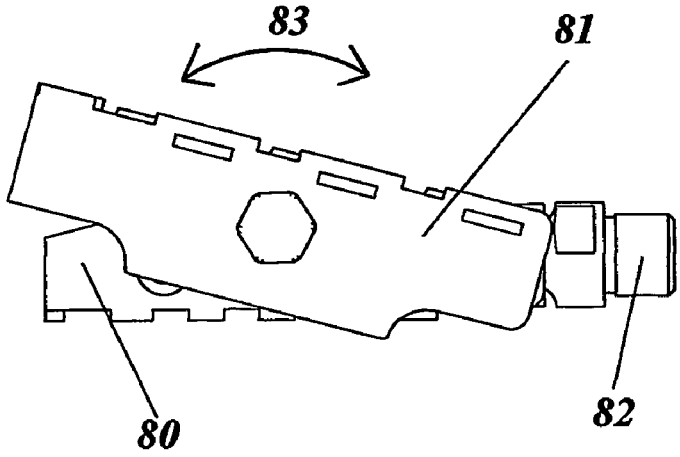

FIG. 11*a*-11*b* show a pedal with tilt function.

As described in the inventor's earlier applications, exercise during controlled instability provides positive health results and qualities to a persons muscles, tendons and overall balance of the body, both during strength training and during rehabilitation after an injury. The following description will show how an exercise apparatus in the form of an exercise bicycle for indoor use is designed to give a person simulated experience as if using a more ordinary mobile bicycle.

Figure 1:
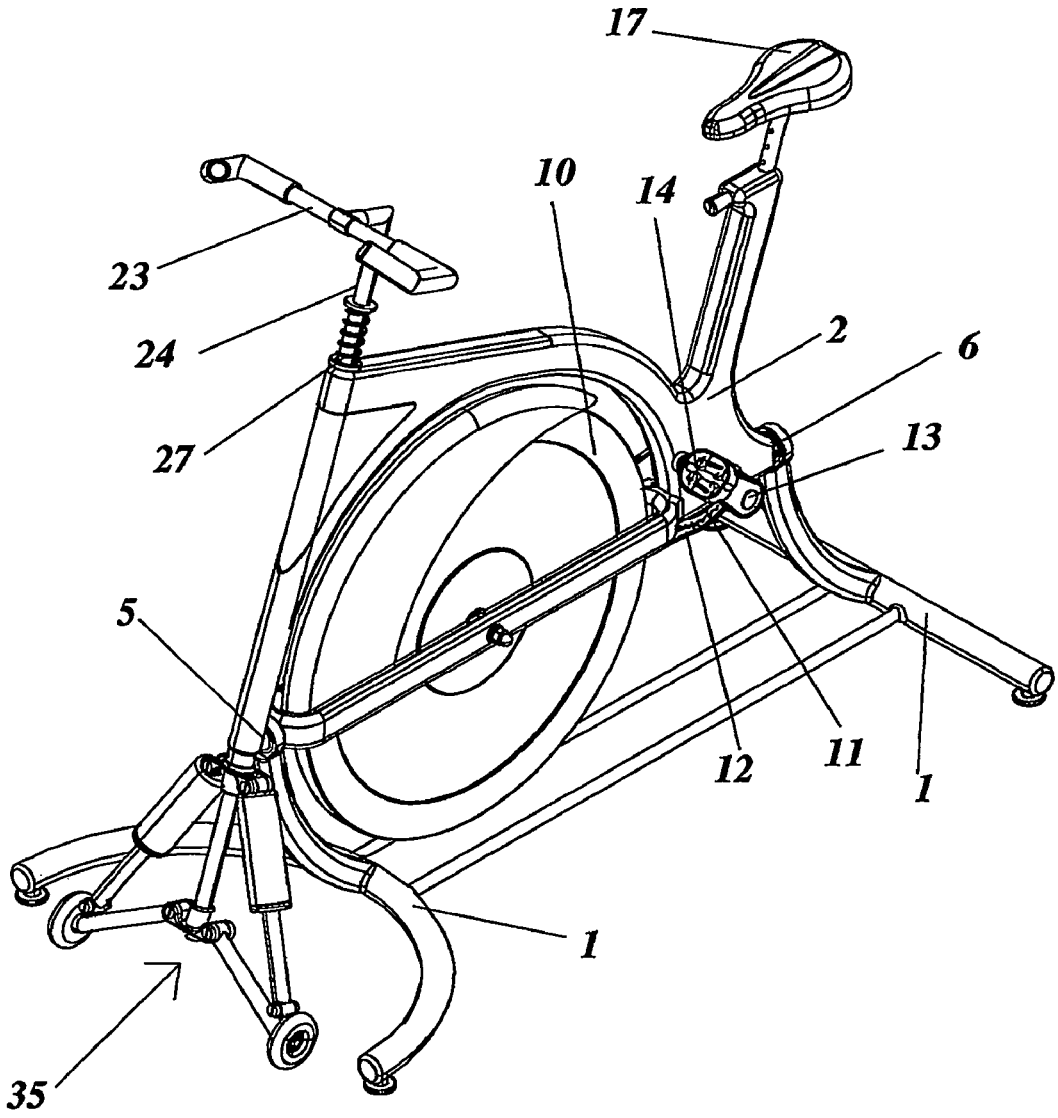
FIG. 1 shows in perspective view the exercise bicycle according to the invention.
Figure 2:
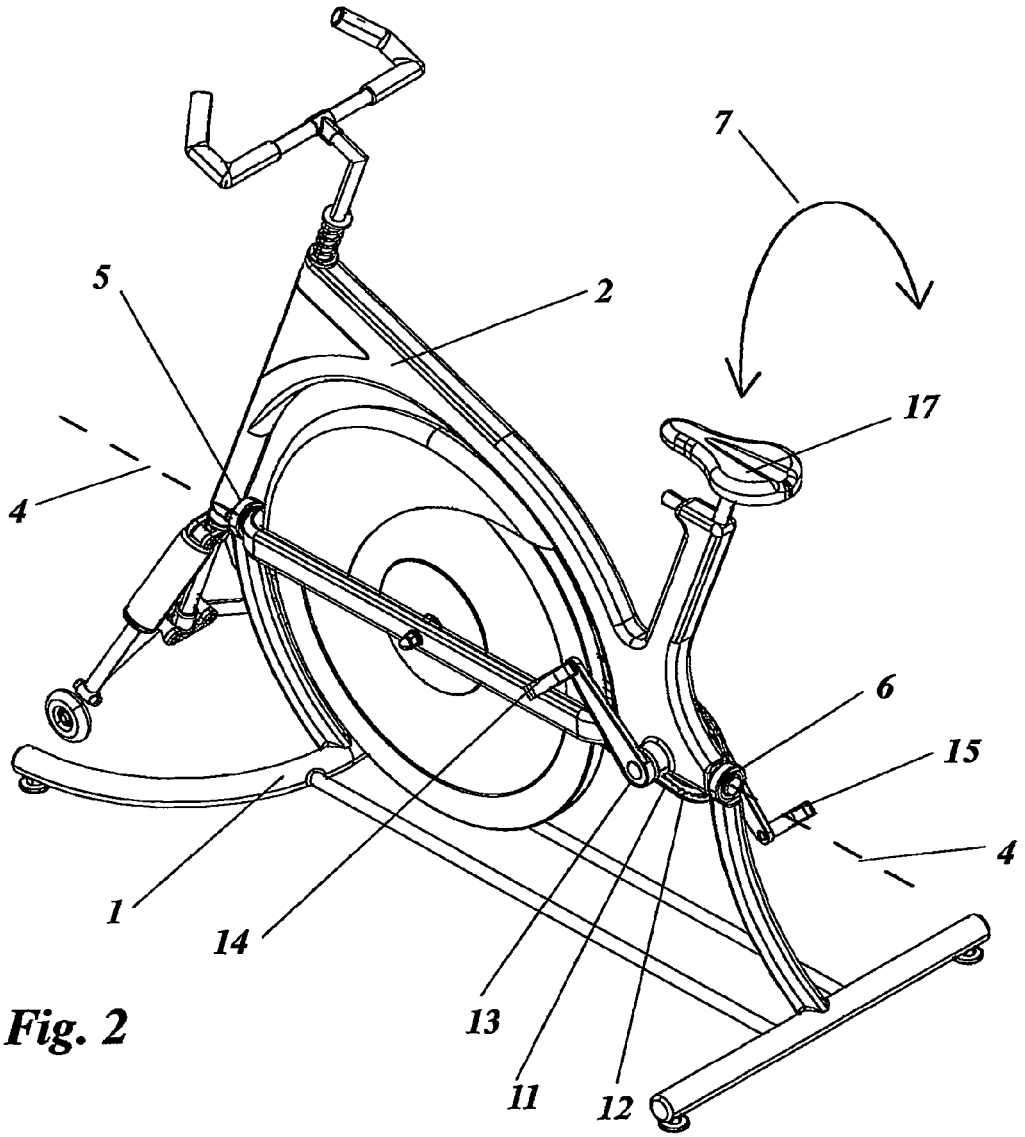
FIGS. 2 and 3 show another perspective view of the invention with the axis of tilt.
Figure 3:
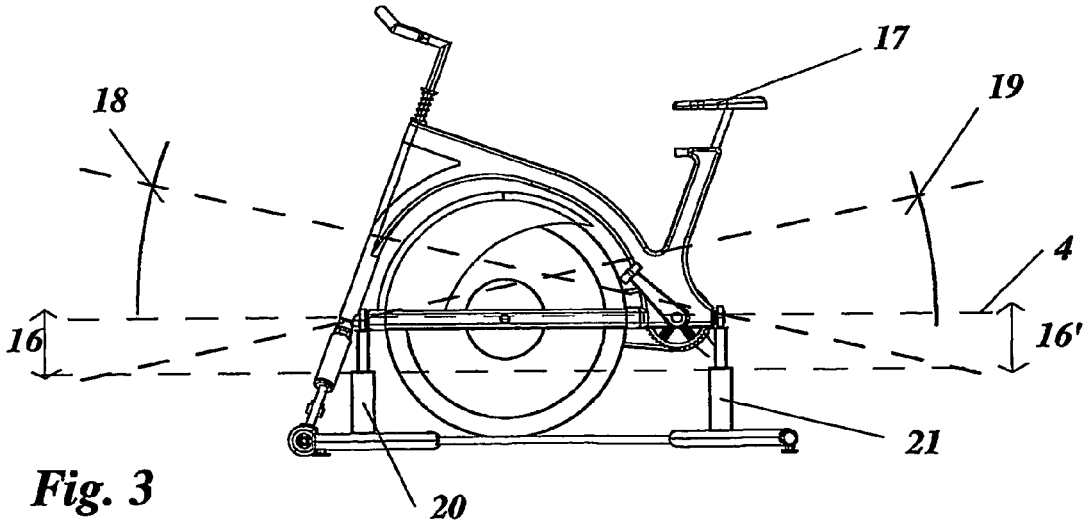

FIG. 1 show an exercise apparatus representing an indoor stationary exercise bicycle, including a first lower frame 1 stable relative to a floor, which supports a second upper frame 2, which is tiltable attached to the first frame 1. As shown in FIGS. 2 and 3 the second upper frame 2 is tiltable through axis 4 relative to the first lower frame and the floor, bearings (not shown) connecting the two frames 1 and 2 are positioned in the forward 5 and rear 6 part of the frames, the bearings being of for example slide bearings or ball bearings. Tilt motion is indicated by arrow 7. A flywheel 10 is rotatable fastened to the upper frame 2 connected to drive means, as a belt or a chain 11 which via a cog or sprocket 12 transfers motion to the flywheel through a crank 13 with pedals 14 and 15. The drive means are mechanically similar to that of prior art and is therefore not shown in more detail on the figures thus will not be commented any further. A seat 17 is fixed on the upper frame 2 in a familiar manner.

An additional feature to the tilt motion is achieved by including means for adjusting the height between frames 1 and 2 at locations 5 and 6. As shown by arrows 16-16' the angle is made variable on axis 4 as indicated by numbers 18 and 19. This is made possible when support part of lower frame 1 has two support parts 20 and 21, which are adjustable in the vertical direction. Support parts 20 and 21 may be hydraulic cylinders, or rotatable worm gears or threaded bolts, which are adjusted manually or by use of auto assisted mechanics as for example a pump or electric motor. Further explanation of this is described with regards to FIG. 10 below.

Regarding FIG. 4 the system of balance control and stabilisation of the exercise apparatus according to the invention will be described. The apparatus has a steering gear and handlebar 23 where a steering rod 24 is able to turn as indicated by arrows 25, and moveable in the direction of length as indicated by arrow 26, relative to the upper frame 2. To the lower part of and on two sides of the steering rod 24 is movable fastened two cylindrical dampers 28 and 29, the dampers either being of hydraulic type or gas type.

As disclosed in FIGS. 1-4*a* and from detail in FIG. 5 two wheels 30 and 31 is rotatable fastened on linkage bars 32 and 33, which are movable hinged on two sides and at end portion of steering rod 24 in joint 34. Dampers 28 and 29 are located between steering rod 24, at joint 34', and to linkage bars 32 and 33 at joints 36 and 37. This forms a movable wheel suspension like unit 35, where wheels 30 and 31 always are in contact with the floor.

As shown on FIG. 4*a* the steering rod 24 is also slideable relative to the upper frame 2 as indicated by arrow 26, where this movement is resilient the rod being in connection with spring 27.

FIGS. 4*a* and 4*b* shows the exercise bicycle in a tilted situation where steering gear is turned towards the direction of tilt. In use the top frame 2 of the exercise bicycle will tend to tilt to one or the other direction. As for a mobile bicycle with two wheels a user will turn the handlebar 23 in the direction the upper frame 2 tends to tilt so to balance the frame in an upright position, the wheels 31 and 30 of the suspension unit 35, are at all time are in contact with the floor. Dampers 28 and 29 provides flexibility, instability and tilt motion of the upper frame 2, the movements controlled by turning steering gear 23 and thus suspension unit 35. Tilt of the upper frame 2 compresses one of the dampers 28 or 29 to a level where the dampers stop the tilt motion. Turning of the steering gear forces to further shorten one of the dampers, but when the damper is fully compressed it gives no room for further turning of steering gear without forcing the upper frame 2 in an upright position.

The suspension unit 25 of the exercise bicycle as shown on FIGS. 1 to 5 has wheels 30 and 31. FIG. 6 show the suspension unit where wheels are exchanged with balls 40 and 41, which are positioned in cup like supports 42 and 43. FIG. 7 shows suspension unit with turnable wheels 44 and 45, similar to that found on office chairs.

The exercise bicycle is most unstable when the flywheel 10 is static or is slowly revolving. When speed of revolution increases the gyroscopic effect of the flywheel will provide a stabilising effect of the exercise bicycle, and the need for stabilising the tilt movement of the upper frame 2 by turning of the handlebar is at a minimum. A user may also stabilize the exercise bicycle by distributing its weight on either side of the frame sitting or standing whilst pedaling. The use is in other words familiar to anyone mastering the technique of using any two-wheeled mobile bicycle.

For a user of the exercise bicycle according to the invention it would be advantageous to have the option to adjust its tilt function or simply to lock the upper frame 2 in a fixed position if the tilt function is not desired.

Users who share one exercise bicycle may be of different size and weight and it would therefore be necessary to adapt the tilt movement of the upper frame. FIG. 8 shows an exercise bicycle according to the invention where dampers 28 and 29 are of hydraulic type and coupled to a fluid reservoir or tank 50 with hoses 51 and 52. The tank is coupled with a pump and lever 54, which is located on the steering gear 23 of the apparatus. The hydraulic system is also coupled with a pressure gauge 55. The user may with this system adjust the pressure in the dampers 28 and 29 by use of lever 54, which adjusts the flexibility of the dampers and the upper frame 2 level of tilt from a locked position to a fully unstable and tiltable situation.

The apparatus may also be assisted of technical means, which provides for an auto-assisted adjustment of the tilt function. FIG. 9 shows the exercise apparatus where dampers 28 and 29 are part of a hydraulic system. The dampers are coupled with hoses 51 and 52 to tank 58 and pump 57. Pump 57 is preferably assisted by an electric motor. The exercise apparatus has a computer unit (CPU) 60, which is the control unit for the functions within the apparatus. An interface console 61, and means of display 62, or preferably a touch screen, is connected with a CPU 60. The CPU is programmed to show a menu on the screen so the user easily can set the function of the apparatus. From CPU 60 a cable 64 is connected to pump 57 in order to control the hydraulic system.

The users may from the interface console set desired level of instability. The exercise bicycle has also a system providing resistance to the rotation of the flywheel, thus creating resistance to the user of the apparatus. The mechanism, here indicated by number 70, may be of prior art of which technical means is used on ergometer cycles and spinning cycles today on the market. Usually this being a kind of braking system using a belt or brake shoe on a wheel or disc surface, or of an electromagnetic system which affects directly the flywheel, such as an eddie current brake system.

FIG. 10 shows a block schematic, which illustrates the relation between the different components within the exercise apparatus and control system also commented above regarding FIG. 9. Upper frame 2 is influenced by dampers 28 and 29, which again is part of a hydraulic system, consisting of tank 58 with hydraulic fluid (for example oil), a pump 57 and activator 56. From the CPU 60, signals are sent to an activator 56 which can start pump 57, which increases pressures of dampers 28 and 29. The pressure may be lowered opening valve 59, also controlled by activator 56. If the incline and decline function as explained relative to FIG. 3, dampers 64 and 65 are coupled with the hydraulic system. This applies to a function making different angles of the upper frame 2 for simulating a movement of the exercise apparatus cycling up and down hill, as for a mobile bicycle on road or in terrain. Dampers 64 and 65 may be replaced with motor assisted threaded bolts or cylinders, coupled with an activator and CPU. The mechanism creating resistance 70 is coupled to CPU 60 which through interface console 61 and screen 62 the user may adjust the exercise apparatus to the desired resistance. The exercise apparatus also has a sensor 66 which measures the revolutions of the flywheel 10, and which is connected to the CPU 60 for computing the revolutions to simulate distance, and to compute the amount of training relative to a time unit.

The exercise apparatus according to the invention as shown in FIG. 10 provides the user with an indoor exercise bicycle which simulate a two wheeled mobile bicycle which during use is easy to adjust according to the users needs and desires of instability and resistance. The CPU may also have programmes, which automatically controls the exercise apparatus functions, and which can give a user exercise programmes which simulate biking on different tracks and terrains.

FIG. 11*a*-11*b* show pedals with one normal pedal surface 80 and one tiltable surface 81, which tilts across the rotatable pedal axle 82. Arrow 83 indicates tilt direction. This kind of pedal is disclosed in the inventor's publication WO00/68067. Utilising such a pedal on the exercise apparatus according to the invention here described will provide the user with increased exercise effect in legs and ankles as the pedals will provide for an extra dimension of instability.

An unstable exercise apparatus according to the invention will provide the user with advantages in regards to rehabilitation and prevention of injuries, and provide as means for increasing balancing skills.

The invention claimed is:

1. A training apparatus for physical exercise, preventive exercise and rehabilitation of injuries and increased balance, the apparatus designed as a stationary exercise bicycle, such as ergometer bike or spinning bike, the apparatus comprising:

a first stable frame configured to be supportable by a floor, and a second frame which is pivotally connected with the first frame in order to allow the second frame to tilt transversely relative to the first frame, and which second frame has a flywheel rotatably attached thereto, means for transmission of motion from a crank device with pedals to the flywheel, and means for rotary resistance on the flywheel and adjustment of the resistance, characterised in:

that the second frame has a rear region and a front region, and has a seat at the rear region, the front region including a steering gear and a suspension unit capable of controlling tilt movement of the second frame relative to the first frame, that the steering gear and suspension unit comprises a handlebar and a steering rod extending downwards from the handlebar through a front member of the second frame, the steering rod being guided through the front member of the second frame, where a part of the steering rod extends below the front member, that said part of the steering rod that extends below the front member has a lowest end and an upper region, and a pair of linkage bars are pivotally linked to the lowest end, said linkage bars having outermost opposite ends and their opposite outermost ends being provided with wheels, that dampers are provided at the front region and have an upper end pivotally attached to the upper region of said part of the steering rod, and have respective lower ends pivotally attached to respective opposite outermost ends of said linkage bars, that said wheels are configured to be supportable by a floor on which the first frame is supportable, that the steering gear and suspension unit with its handlebar, its steering rod its linkage bars, its wheels and dampers are turnable relative to the first and second frame, and that a biasing spring is provided on the steering rod and the steering rod is slideable relative to the front member of the second frame against spring force of the biasing spring.

2. A training apparatus according to claim 1 wherein, the dampers are selected from the group consisting of hydraulic type and gas type.

3. A training apparatus according to claim 1, wherein the dampers are of hydraulic type and are connected to a hydraulic system which includes a hydraulic fluid tank and a pump, hydraulic fluid hoses connecting the pump with the dampers with means for varying pressure in the dampers such that pressure in the dampers is variable in order to adjust the degree of movability of the second and upper frame relative to the first frame.

4. A training apparatus according to claim 3, wherein the pump is powered by an electric motor, wherein the hydraulic system further has an activator connected to the motor, to a return valve and to a central processing unit CPU, wherein the CPU is connected to an interface control console with visual means, the interface control console being located on the handlebar of the steering gear, to permit the adjustment of the training apparatus and the hydraulic system from the interface control console.

5. A training apparatus according to claim 1, wherein the dampers are extendible and contractible and tilting of the upper second frame in a first transverse direction relative to the first frame will shorten one of the dampers to a point where turning of the steering gear in the same direction as the tilt movement gives a resistance within said one damper, thus forcing the second frame in a transverse direction opposite to the first direction towards an upright position.

6. A training apparatus according to claim 1, wherein the first frame has front and rear frame pivot points that pivotally support the second frame at the front and rear regions and means for vertically adjusting the front and rear levels of the pivot points independently to provide a variable angle of tilt of the second frame relative to the horizontal, the angle of tilt adjustment being in a vertical plane and parallel to the length of the apparatus, and wherein the means for vertically adjusting the front and rear levels of the pivot points being electable from the group of: threaded cylinders, motor assisted threaded cylinders, and threaded cylinders of hydraulic type coupled to pumps of manual or motorised type.

7. A training apparatus according to claim 6, including an interface control console within the apparatus to permit adjustment of the training apparatus and the hydraulic system wherein the hydraulic cylinders for adjusting the angle of tilt of the second frame are connected to the said hydraulic system and interface console within the apparatus.

8. A training apparatus according to claim 4, wherein the CPU includes software for enabling user input and control of the apparatus modes of resistance upon drive means, flywheel and pedals, as well as transverse tilt functions of the second frame relative to the first frame ranging from fixed stable position to a full unsupported tilt function.

9. A training apparatus according to claim 4, wherein the CPU includes software for enabling a user of the apparatus to elect among one of: a plurality of choices regarding incline or decline angle of a tilt axis of the second frame, and an active angle control of the tilt axis of the second frame during usage of the training apparatus for simulating terrain and up-hill or down-hill situations as part of an exercise program.

10. A training apparatus according to claim 3, wherein the dampers are extendible and contractible and tilting of the upper second frame in a first transverse direction relative to the first frame will shorten one of the dampers to a point where turning of the steering gear in the same direction as the tilt movement gives a resistance within said one damper, thus forcing the second frame in a transverse direction opposite to the first direction towards an upright position.

11. A training apparatus according to claim 4, wherein the first frame has front and rear frame pivot points that pivotally support the second frame at the front and rear regions and means for vertically adjusting front and rear levels the pivot points independently to provide a variable angle of a tilt of the second frame relative to the horizontal, the angle of tilt being in a vertical plane and parallel to the length of the apparatus, and that the means for vertically adjusting front and rear levels of the pivot points being electable from the group of: threaded cylinders, motor assisted threaded cylinders, and threaded cylinders of hydraulic type coupled to pumps of manual or motorised type.

* * * * *